United States Patent [19]

Picarello

[11] 4,228,663

[45] Oct. 21, 1980

[54] APPARATUS FOR REDUCING ICE BUILD-UP ON A DISCHARGE GRILL OF A HEAT PUMP OUTDOOR UNIT

[75] Inventor: Joseph F. Picarello, York, Pa.

[73] Assignee: Borg-Warner Corporation, Chicago, Ill.

[21] Appl. No.: 57,487

[22] Filed: Jul. 13, 1979

[51] Int. Cl.[3] ..... F25B 39/04

[52] U.S. Cl. ..... 62/507; 165/122

[58] Field of Search ..... 62/506, 507, 508; 126/25 A; 98/114, 40 D, 40 B, 42 R, 42 A; 52/199, 200; 165/122

[56] References Cited

U.S. PATENT DOCUMENTS

| | | | |
|---|---|---|---|
| 464,204 | 12/1891 | Sugg | 98/42 |
| 811,764 | 2/1906 | Colegrove et al. | 98/42 |
| 1,028,958 | 6/1912 | Phillips | 98/42 |
| 2,826,136 | 3/1958 | Smith | 98/42 |
| 2,878,743 | 3/1959 | Trunnell | 98/42 |
| 3,865,517 | 2/1975 | Simmons et al. | 62/507 |
| 4,036,292 | 7/1977 | Hine, Jr. | 62/507 |
| 4,090,436 | 5/1978 | Wright | 98/114 |

*Primary Examiner*—Ronald C. Capossela
*Attorney, Agent, or Firm*—Davis Chin

[57] ABSTRACT

An apparatus for reducing the amount of ice buildup on a discharge grill of a heat pump outdoor unit includes an ice ring surrounding a central part of the grill for preventing the formation of ice thereon. The apparatus has a support member disposed within the ice ring and is positioned over a central disc of the grill for supporting an ice disc. The ice disc is mounted upon the support member for preventing the entrance of freezing rain, sleet or the like onto the central area of the grill so as to minimize the formation of ice.

10 Claims, 7 Drawing Figures

APPARATUS FOR REDUCING ICE BUILD-UP ON A DISCHARGE GRILL OF A HEAT PUMP OUTDOOR UNIT

BACKGROUND OF THE INVENTION

This invention relates generally to protective devices or more particularly, it relates to an apparatus for use on a discharge grill of a heat pump outdoor unit and the like to reduce the amount of ice build-up thereon.

It has been generally known that in many parts of the country there are occasionally freezing rain and/or sleet during the winter season. Under such weather conditions, it is common for the discharge grill on a heat pump outdoor unit to become covered with ice, thus impairing the normal operation of the unit. While these heat pump outdoor units are typically provided with a defrost-sensing device so as to remove the frost on the coil of the unit, the ice will continue to remain on the discharge grill area thus blocking the normal passage of air flow out of the unit and preventing efficient operation thereof.

It would, therefore, be desirable to provide an apparatus in accordance with the present invention for reducing the amount of ice build-up on the discharge grill of a heat pump outdoor unit by affording adequate weather protection. The apparatus of the present invention will also maintain a passage open to thereby avoid undesired restrictions of air flow so as to allow proper sensing of when defrosting of the outdoor coil is required. In addition, the apparatus will also not significantly block the air flow during the summer cooling season when the unit is operating in the air conditioning mode so as to cause a reduction in capacity. Consequently, the apparatus can be maintained on the unit all yearround without any meaningful loss in performance.

SUMMARY OF THE INVENTION

Accordingly, it is a general object of the present invention to provide an apparatus for reducing the amount of ice build-up on a discharge grill of a heat pump outdoor unit or the like.

It is an object of the present invention to provide an apparatus for a discharge grill of a heat pump outdoor unit which is adapted to afford good weather protection as well as to prevent undesired restriction of air flow through the unit.

It is another object of the present invention to provide an apparatus for use on a discharge grill of a heat pump outdoor unit which is of a simple construction and is relatively easy to manufacture and install.

In accordance with these aims and objectives of the invention, there is provided an apparatus for reducing the amount of ice build-up on a discharge grill of a heat pump outdoor unit which includes a body member for surrounding a central part of the discharge grill for preventing the formation of ice thereon. The apparatus includes a support member which is located within the body member and is positioned over a central disc of the discharge grill for supporting a cover member. The cover member is mounted upon the support member for preventing the entrance of freezing rain, sleet, or the like onto the central area of the grill so as to minimize the formation of ice.

The body member can be an ice ring formed of four sections which are interconnected together for surrounding a central part of the discharge grill. Each section includes a left-handed member, a right-handed member and a center V-shaped portion. Additionally, the support member consists of a flat base member and a pair of side mounting flanges formed integrally with the base member. Also, the cover member consists of a flat circularshaped base member with a downturned lip formed integrally around its perimeter.

DESCRIPTION OF THE DRAWINGS

These and other objects and advantages of the present invention will become more fully apparent from the following detailed description when read in conjunction with the accompanying drawings wherein.

DETAILED DESCRIPTION OF THE PREFERRED EMBODIMENT

Figure 1:
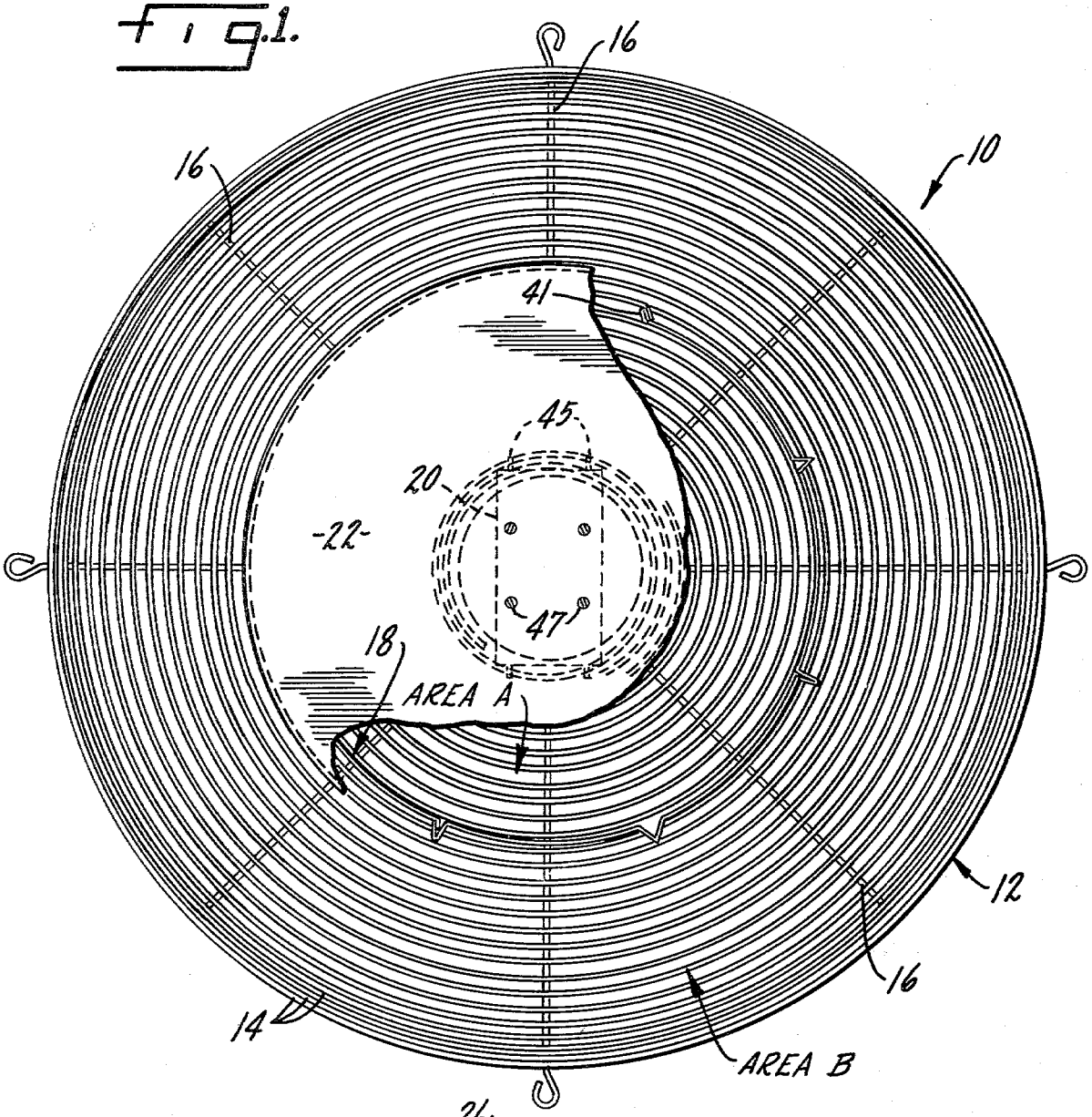
FIG. 1 is a top plan view, with certain portions thereof being broken away for clarity, of an improved discharge grill with means for reducing the amount of ice build-up thereon, constructed according to the principles of the present invention.
Figure 6:
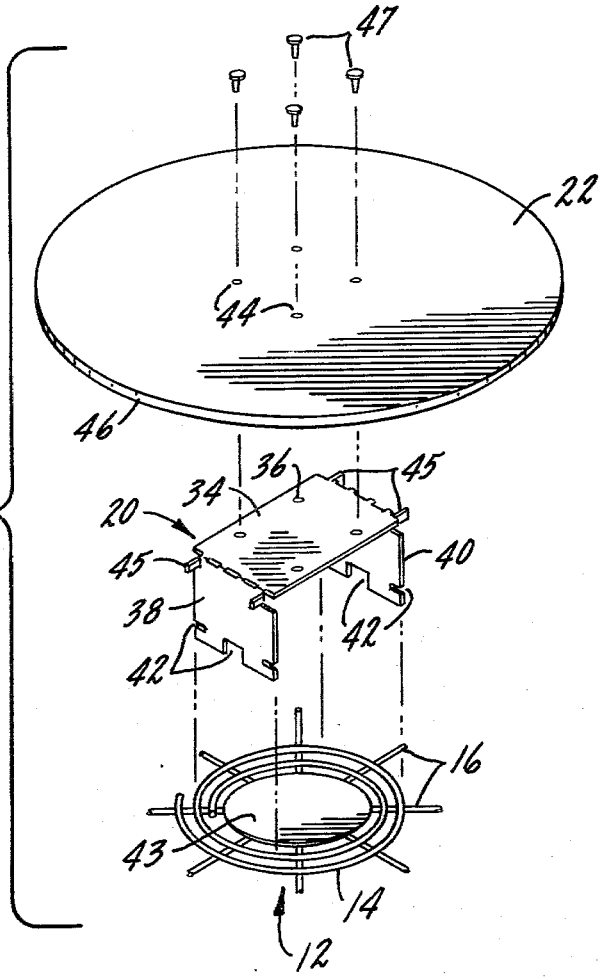
FIG. 6 is an exploded, perspective view of the apparatus for reducing the amount of ice build-up on a grill, according to the present invention.

Referring now in particular to the drawings, and particularly to FIGS. 1 and 6 there is shown a grill provided with means for reducing the amount of ice build-up thereon generally designated by reference numeral 10 including a discharge grill 12 of a heat pump outdoor unit (not shown). The grill 12 is constructed of a plurality of circular-shaped wire members 14 which are concentrically arranged and joined together by radially extending rib members 16. The apparatus 10 of the present invention also includes an ice ring 18, an ice disc support member 20, and an ice disc 22, all being preferably formed of sheet metal or other suitable material. Like reference numerals have been employed throughout the various drawings to designate the like parts.

As best shown in FIGS. 2 through 5 of the drawings, the ice ring functioning as a body means is formed of four ice ring sections 23 which are interconnected together for surrounding a central part or area A (FIGS. 1 and 7) of the grill 12. Each of the ice ring sections 23 (FIGS. 4 and 5) includes a first or left-handed member 24, a second or right-handed member 26 and a center V-shaped portion 28. Each of the members 24 and 26 is provided in substantially its middle section with a rectangularly hat-shaped recess 30. The center V-shaped portion 28 is provided with an oval-shaped notch 32. The left end of the member 24 is joined integrally to a first terminal portion 29 having a lip 31 and a half oval-shaped opening 33. The right end of the member 26 is joined integrally to a second terminal portion 35 having a half oval-shaped opening 37.

Figure 2:
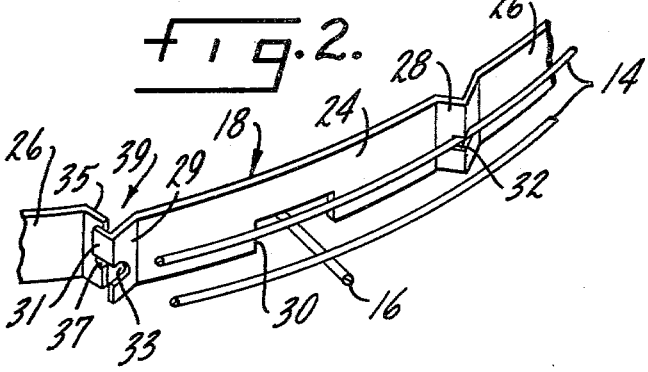
FIG. 2 is a fragmentary, prospective view of the assembled ice ring, according to the present invention.
Figure 3:
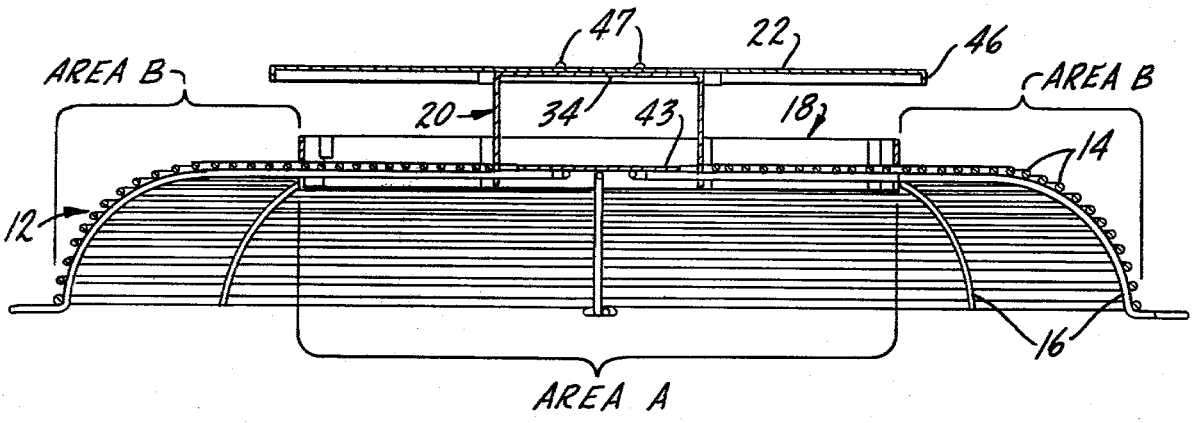
FIG. 3 is a sectional view showing the relationship of the ice ring section, support member and the cover member.

During assembly, the four ice ring sections 23 are disposed circumferentially about the discharge grill 12 to form the enclosed area A. This is accomplished by placing the sections 23 at a predetermined distance from the center of the grill so that the wire members 14 mate between the notches 32 and the approximate center of the recess 30 rests upon the rib members 16, as best seen in FIG. 2. The lip 31 of the first terminal portion 29 of each section 23 are caused to overlap and/or interlock with the second terminal portion 35 of another section 23 to form another V-shaped portion 39. Each of the portions 39 are pinched closed and the last portion 39 which completes the ice ring 18 is provided with a clip 41 (FIG. 1) formed preferably of sheet metal for affixing securely together the ice ring without the use of screws. It should be noted that the opening 33 on the first terminal portion 29 and the opening 37 on the second terminal portion 35 co-mate and interfit with the wire member 14 of the grill 12.

The ice disc support member 20 defining support means includes a flat circular-shaped base member 34 having a plurality of openings 36 for mounting the ice disc 22, which is to be explained more fully hereinafter. The base member 34 also includes a pair of side mounting flange portions 38 and 40 formed integrally therewith. Each of the side portions 38 and 40 are provided with rectangularly-shaped slots 42 which are adapted for cooperative engagement with the wire members 14 and the rib members 16 of the grill 12 so that installation can be accomplished without the necessity of screws as can best be seen in FIG. 6. The support member 20 is mounted within the ice ring 18 and covers a central disc 43 of the grill 12. In order to facilitate the supporting of the ice disc 22, the support member 20 further includes a plurality of outwardly extending projections 45.

The ice disc 22 functioning as a protective or cover means is provided in its central part with a plurality of openings 44 which are aligned with the respective openings 36 in the ice disc support member 20. For installing the disc 22, mounting means such as screws 47 preferably of the self-tapping type can be inserted through the openings 44 and openings 36 for securing the disc 22 to the support member 20. The ice disc 22 also includes an integral downturned perimeter flange or lip 46.

In use and operation of the apparatus 10, the ice disc 22 effectively prevents the entrance of rain, sleet and the like into the central area of the discharge grill. It should be clearly understood by those skilled in the art that the diameter of the disc 22 can be of any size as desired so to protect the grill area from precipitation while yet not significantly restricting the air flow. The side portions 38 and 40 can be made of any desired length so as to hold the disc 22 at a desired height above the grill 12. In the preferred embodiment, the ice disc diameter is approximately 0.50 to 0.80 times the diameter of the discharge grill. The assembled ice ring has a diameter approximately 0.80 to 0.90 times the ice disc diameter. In addition, the ice disc is positioned above the grill at a height of approximately 0.10 to 0.20 times the ice disc diameter, and the distance between the top of the ice ring and the ice disc is approximately 0.30 to 0.40 times the height of the ice disc above the grill. The downturned perimeter flange 46 of the disc 22 serves to deflect any rain, sleet or snow from falling onto the central area A of the grill area inside the ice ring 18. The ice ring 18 also functions to minimize ice formation in the central area A of the grill 12 under the disc 22 by blocking the entrance of such rain or sleet.

Figure 7:
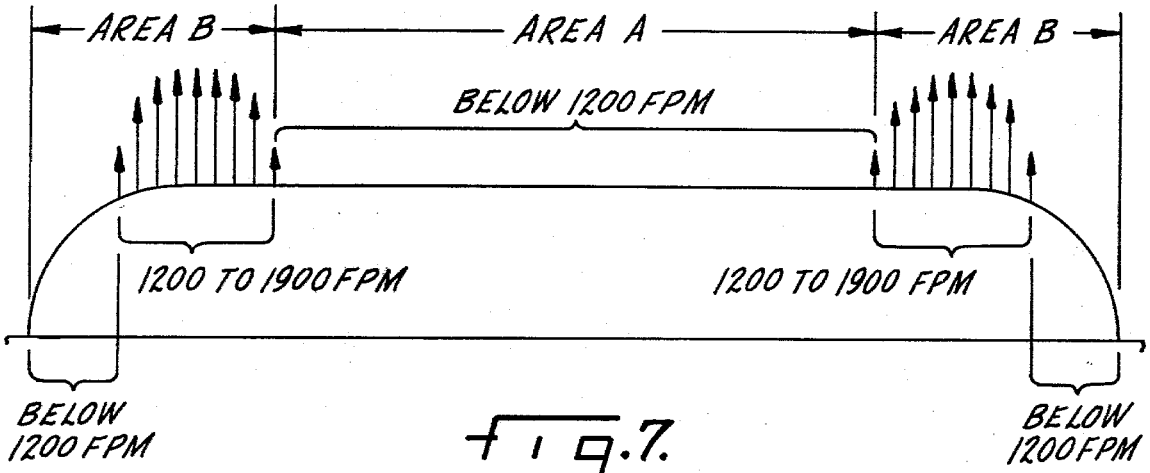
FIG. 7 is a diagrammatical view showing a typical air flow pattern leaving the discharge grill under normal operating conditions.
Figure 4:
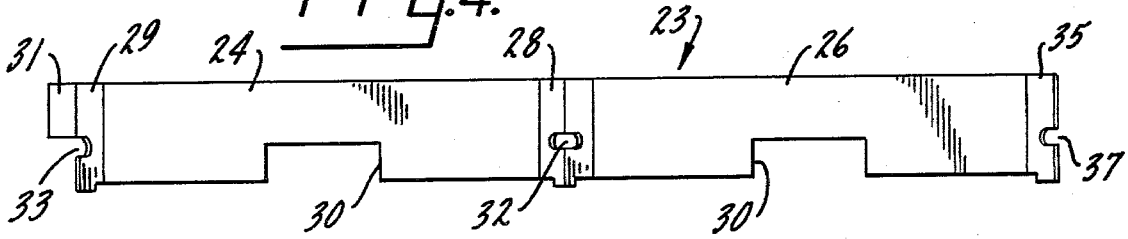
FIG. 4 is a front elevational view of the ice ring section.
Figure 5:
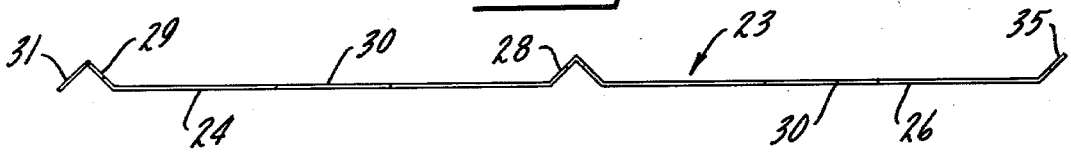
FIG. 5 is a bottom view of the ice ring section shown in FIG. 4.

Under normal operating conditions, the passage of air flow will be through area B of the grill 12 in the direction as indicated by the arrows as shown in FIG. 7. However, as the grill area B outside of the ice ring 18 and the disc 22 is covered with ice the air flow becomes blocked. This restriction of flow will cause the air velocity through the area A to increase thus preventing any freezing rain or sleet from entering into the area underneath the disc 22. Thereafter, only the area A inside of the ice ring 18 and the ice disc 22 will allow sufficient air flow therethrough so as to provide proper sensing of when defrosting of the coil of the heat pump outdoor unit is required.

From the foregoing detailed description, it can thus be seen that the present invention provides an apparatus for reducing the amount of ice build-up on a discharge grill of a heat pump outdoor unit consisting of an ice ring, a support member, and an ice disc. The instant invention provides an efficient and economical apparatus for affording adequate weather protection yet avoiding undesired restriction of air flow thereby insuring proper operation of the heat pump outdoor unit.

While there has been illustrated and described what is at present to be a preferred embodiment of the present invention, it will be understood by those skilled in the art that various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention but that the invention will include all embodiments falling within the scope of the appended claims.

What is claimed is:

1. An apparatus for reducing the amount of ice build-up on a discharge grill of a heat pump outdoor unit and the like, said apparatus comprising:

body means surrounding a central part of the discharge grill for preventing the formation of ice thereon;

support means disposed within said body means over a central disc of the grill for supporting cover means; and cover means mounted upon said support means for preventing the entrance of rain, sleet or the like onto the central area of the grill so as to minimize the formation of ice.

2. An apparatus as claimed in claim 1, wherein said body means comprises an ice ring.

3. An apparatus as claimed in claim 2, wherein said ice ring is formed of four sections which are interconnected together for surrounding the central part of the grill, each section including a first member, a second member and a center V-shaped portion.

4. An apparatus as claimed in claim 3, wherein said support means comprises a flat rectangular-shaped base member and a pair of side mounting flanges formed integrally with said base member.

5. An apparatus as claimed in claim 4, wherein said flanges are provided with slots adapted for engagement with said grill, and said base member is provided with openings adapted for mounting said cover means.

6. An apparatus as claimed in claim 5, wherein said cover means comprises a disc, said disc being provided with openings adapted for mounting to said base member and a perimeter flange for the prevention of the freezing rain or sleet from entering the area underneath said disc.

7. An apparatus as claimed in claim 1, wherein said support means comprises a flat rectangular-shaped base member and a pair of side mounting flanges formed integrally with said base member.

8. An apparatus as claimed in claim 7, wherein said flanges are provided with slots adapted for engagement with said grill, and said base member is provided with openings adapted for mounting said cover means.

9. An apparatus as claimed in claim 1, wherein said cover means comprises an ice disc.

10. An apparatus as claimed in claim 9, wherein said disc is provided with openings adapted for mounting to said support means.

* * * * *